United States Patent [19]

Russell

[11] Patent Number: 5,027,585

[45] Date of Patent: Jul. 2, 1991

[54] PACKAGING METHOD AND APPARATUS USING ROTATABLE MANDREL ASSEMBLY

[76] Inventor: William Russell, 102 Sherbourne Road, Horinger Court Estate, Bury St. Edmunds, Suffolk, United Kingdom, IP33 2ET

[21] Appl. No.: 393,988

[22] Filed: Aug. 15, 1989

[30] Foreign Application Priority Data

Aug. 17, 1988 [GB] United Kingdom ..... 8819573

[51] Int. Cl.[5] ..... B65B 43/60

[52] U.S. Cl. ..... 53/458; 53/565; 493/165

[58] Field of Search ..... 493/165, 164, 163, 175, 493/176, 184; 53/565, 564, 458, 457, 452

[56] References Cited

U.S. PATENT DOCUMENTS

| | | | |
|---|---|---|---|
| Re. 26,656 | 9/1969 | Guzzardo | 493/165 X |
| 3,120,089 | 2/1964 | Monroe et al. | 53/565 |
| 4,337,059 | 6/1982 | Allen et al. | 493/184 |

*Primary Examiner*—James F. Coan

*Attorney, Agent, or Firm*—John C. Evans

[57] ABSTRACT

In a packaging system, carton sleeves are sealingly closed at their bottoms while received upon respective mandrels, the open-topped cartons are removed from the mandrels and filled, and the filled cartons are sealingly closed at their tops. Between the bottoms being sealingly closed and the cartons being filled, selected cartons are turned through a right-angle about their own axes to bring their top closure sealing sub-panels into a correct orientation for top-sealing. For enabling such turning the mandrels are turnable about their own axes by a cam displaceable between operative and inoperative positions.

18 Claims, 4 Drawing Sheets

PACKAGING METHOD AND APPARATUS USING ROTATABLE MANDREL ASSEMBLY

FIELD OF THE INVENTION

1. Background of the Invention

This invention relates to a packaging method and to packaging apparatus for performing the method.

2. Description of the Prior Art

GB2100696A discloses a machine for forming, filling and sealing cartons and comprised of eight work stations, namely a straw and sealing tape applicator station, a carton blank wrapping and folding station, a seam and one end bonding station, a carton rotator and conveyor transport station, an other end closure preform station, a filler station, an other end closure sealing station, and a carton ejector station. At the seam and one end bonding station, every carton blank is transferred onto a rotary crossbar mandrel having a horizontal axis, and through a series of operations, a side seam of the carton is sealed, and one end closure of the carton is formed and sealed. At the carton rotator and conveyor transport station, every carton is removed from the crossbar mandrel, turned through a right-angle about its own longitudinal axis, which is horizontal, and inserted upon a conveyor on which the carton remains until ejected from the machine.

U.S. Pat. No. 4,337,059 discloses a packaging machine for forming, filling and sealing cartons, in which machine cartons are indexed in pairs through various work stations to accomplish forming, filling and sealing of the cartons. The forming of the bottom closures of the cartons is performed upon a rotary turret having a vertical axis. The turret is stepped about its axis to bring the cartons into the stations in turn and is of a type which includes two mandrels at each station and which indexes two mandrels from one station to the next station. From the turret, the bottom-closed, open-topped cartons are advanced stepwise linearly by a chain conveyor through various stations in which the cartons are filled and top closures thereof are formed. A difficulty with this machine is that a carton having its top and bottom closures orientated parallelly to each other and a carton having its top and bottom closures orientated perpendicularly to each other require differing machine layouts, especially in respect of the top and bottom closure forming stations.

SUMMARY OF THE INVENTION

According to one aspect of the present invention, there is provided a packaging method comprising advancing carton sleeves, sealingly closing one end of each carton sleeve at one end closing means to form a carton open at its other end, filling at filling means the cartons open at their other ends, sealingly closing at other end closing means the other end of each carton, advancing further carton sleeves, sealingly closing one end of each further carton sleeve at said one end closing means to form a further carton open at its other end, filling at said filling means the further cartons open at their other ends, and sealingly closing at said other end closing means the other end of each further carton, wherein the improvement comprises, relatively to each first-mentioned carton in its path of advance from said sealingly closing its one end to said sealingly closing its other end, turning each further carton about its longitudinal axis through substantially a right-angle between said sealingly closing its one end and said sealingly closing its other end.

According to another aspect of the present invention, there is provided packaging apparatus, comprising one end closing means arranged sealingly to close one end of each of a plurality of carton sleeves to form a carton open at its other end, filling means arranged to fill the cartons open at their other ends, other end closing means arranged sealingly to close the other end of each carton, and advancing means arranged to advance said carton sleeves and said cartons along a path past said one end closing means, said filling means and said other end closing means, in turn, wherein the improvement comprises turning means arranged to turn each of selected ones of said cartons about its longitudinal axis through substantially a right-angle as the carton passes along said path from said one end closing means to said other end closing means, and selecting means serving to select which of said cartons are turned as aforesaid and thus which of said cartons remain unturned by said turning means.

According to a further aspect of the present invention, there is provided packaging apparatus including mandrel mounting means, and one end closing means arranged to close one end of a carton sleeve encircling a mandrel carried by said mandrel mounting means, wherein the improvement comprises turning means arranged to turn said mandrel mounting means through substantially a right-angle about an axis which substantially coincides with the longitudinal axis of the mandrel.

Owing to the invention, it is possible to turn selected cartons through substantially a right-angle whilst other cartons remain unturned. In a particular application of the invention, the time and trouble needed to change a packaging machine over from filling one design of carton to another design of carton is greatly reduced.

BRIEF DESCRIPTION OF THE DRAWINGS

In order that the invention may be clearly understood and readily-carried into effect, reference will now be made, by way of example, to the accompanying drawings, in which.

DESCRIPTION OF THE PREFERRED EMBODIMENTS

Figure 1:
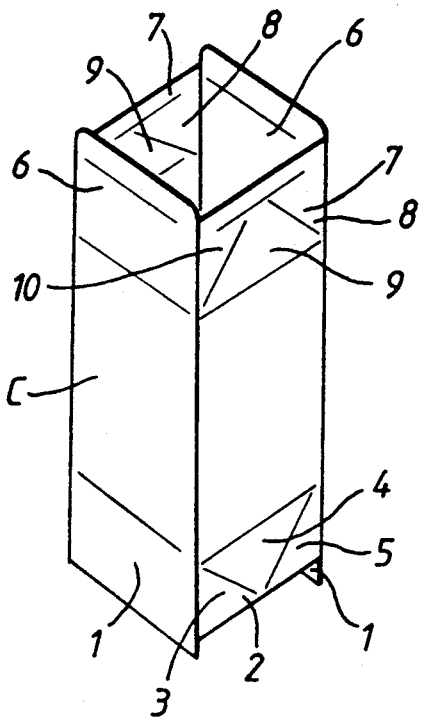
FIG. 1 shows a perspective view of a half-gallon carton sleeve.

Referring to FIG. 1, the half-gallon carton sleeve C shown is conventional and has a bottom closure consisting of two major panels 1 which are situated opposite each other and are substantially rectangular, and two minor panels 2 which are also situated opposite each other and are substantially rectangular, and two minor panels 1 which are situated opposite each other and are substantially rectangular, and two minor panels 2 which are also situated opposite each other and are substantially rectangular. However, each minor panel 2 consists of three triangular sub-panels 3, 4 and 5, of which the sub-panels 3 and 5 are disposed at opposite sides of the sub-panel 4, which is of substantially isosceles form. The sleeve C also includes a flat- or gable-top closure which includes two major panels 6 substantially co-planar with the respective panels 1 and of substantially rectangular form, and two minor panels 7 substantially co-planar with the respective panels 2. Again, each minor panel 7 includes three triangular sub-panels 8, 9 and 10, whereof the sub-panel 9 is of substantially isosceles form. In forming the bottom closure, the panels 1 are turned inwardly about their inner horizontal edges, the panels 2 fold either inwardly or outwardly and the free edge zones of the panels 1 and 2 are heat-and pressure-sealed together. Thus, there is formed an open-topped carton which is then filled with a fluid substance, for example milk or orange juice. Then, to form the flat-or gable-top closure, the panels 6 are turned about their innermost horizontal edges, the panels 7 fold inwardly or outwardly, and the outermost horizontal edge zones of the panels 6 and 7 are heat-and pressure-sealed together. It will be noted that the axes of turning of the panels 1 and 6 are parallel to each other.

Figure 2:
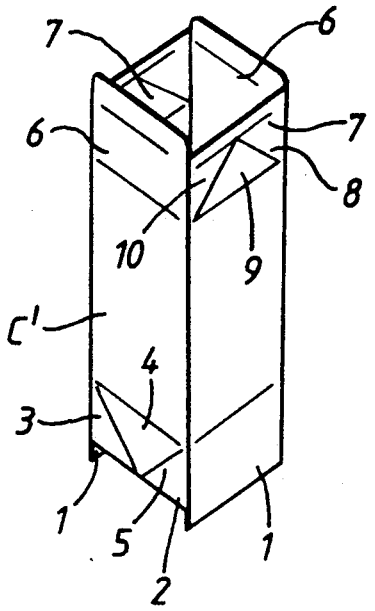
FIG. 2 shows a view similar to FIG. 1 of a liter carton sleeve.

The liter carton sleeve C' shown in FIG. 2 again has the panels 1, 2, 6 and 7 and the sub-panels 3 to 5 and 8 to 10, but the panels 1, prior to turning, lie in parallel vertical planes substantially perpendicular to those in which lie the panels 6, the axes of turning of the panels 1 being perpendicular to the axes of turning of the panels 6.

Figure 7:
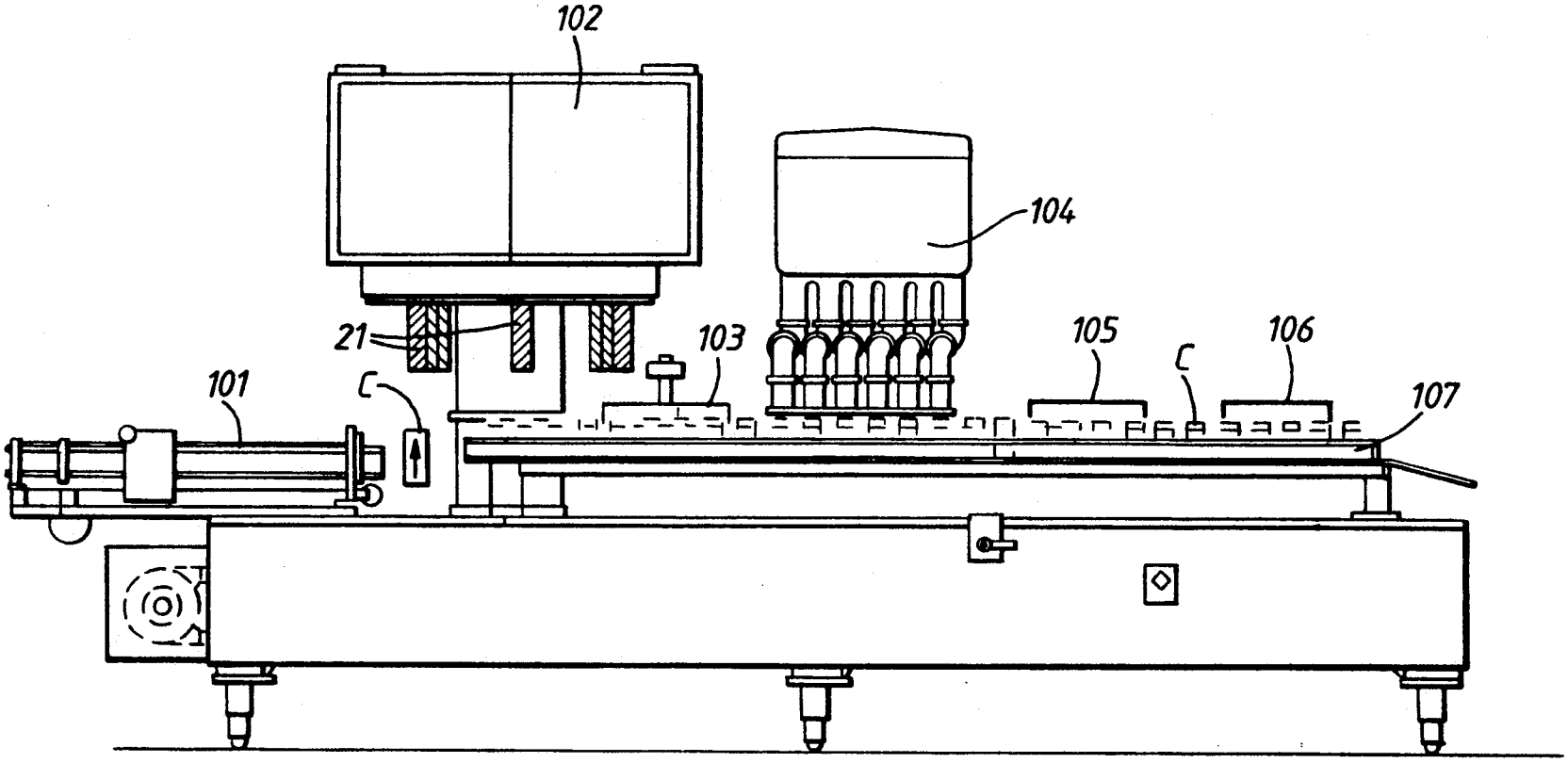
FIG. 7 shows a diagrammatic side elevation of the machine.

Referring to FIG. 7, carton sleeves C are fed in a flat form from a magazine 101, opened to a rectangular form, and bottom-closed on a rotary turret 102, and then top pre-broken at a top closure pre-breaking station 103, filled at one or more filling stations 104, top-heated at a top closure heating station 105, and closed and sealed at a top closure pressure sealing station 106, while being advanced along the machine by a conveyor 107.

Referring to FIGS. 3 to 6, the turret 102 includes a horizontal turntable 20 which rotates stepwise about a vertical axis A and thereby advances eight mandrels 21 through respective stations I to VIII. Flat carton sleeves from a feeder 19 at the station I are opened and placed upwardly over the mandrel 21 at that station. The mandrel in question together with its carton sleeve is then stepped to a bottom closure pre-breaking station II, then to a bottom closure heating station III, thence to a bottom closure pressure sealing station IV, thence to a station V, and to an unloading station VI where the bottom-closed open-topped cartons are advanced by a chain conveyor (not shown) along a horizontal path X through the top closure pre-breaking station 103, the filling station(s) 104, the top closure heating station 105 and the top closure Pressure sealing station 106.

Figure 3:
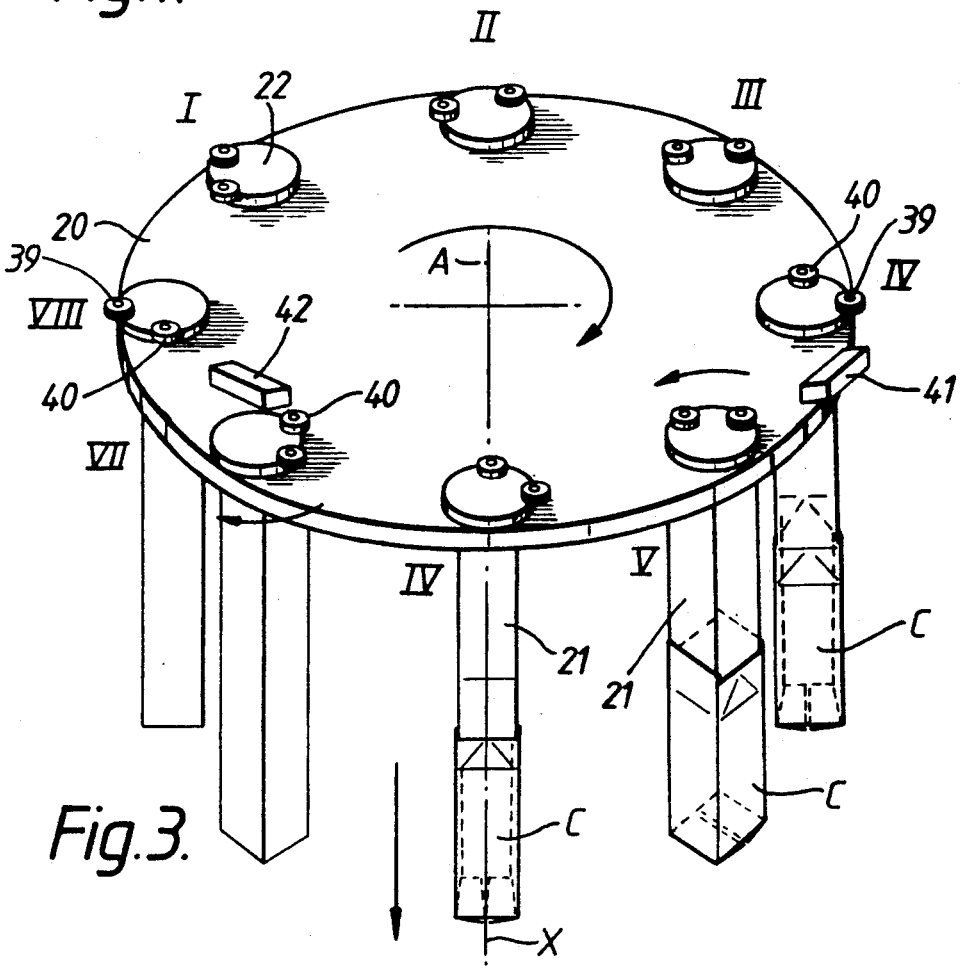
FIG. 3 shows a diagrammatic perspective view of a stepping turntable of a liquid packaging machine.
Figure 4:
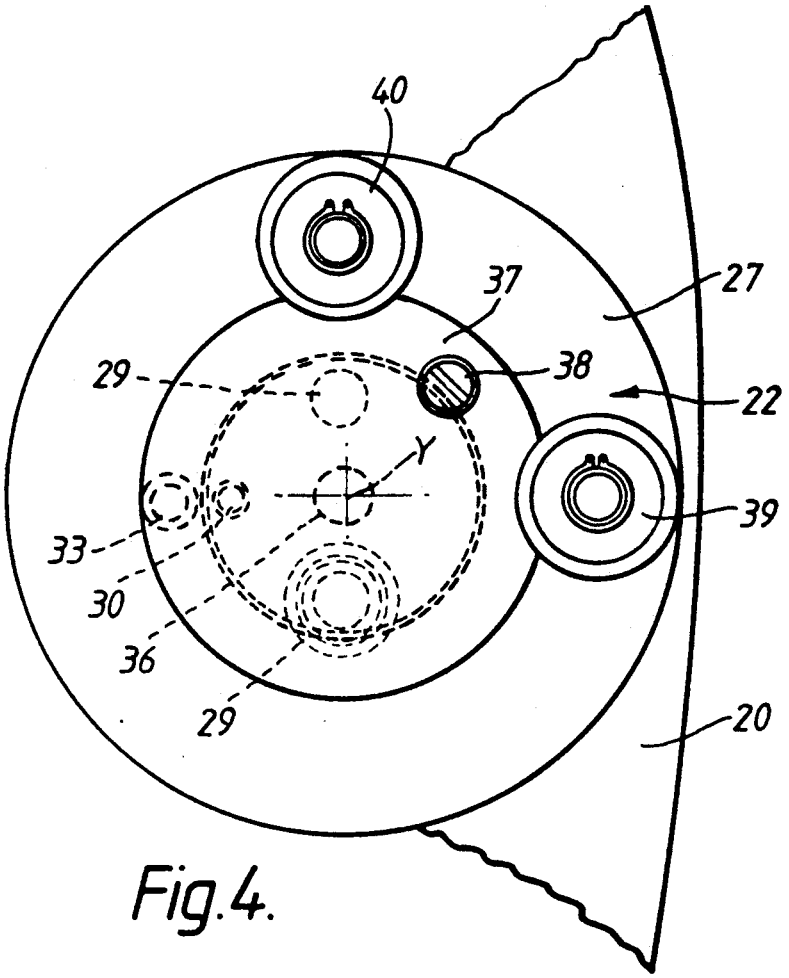
FIG. 4 shows a fragmentary top plan view of one of eight mandrel-mounting devices of the turntable.
Figure 5:
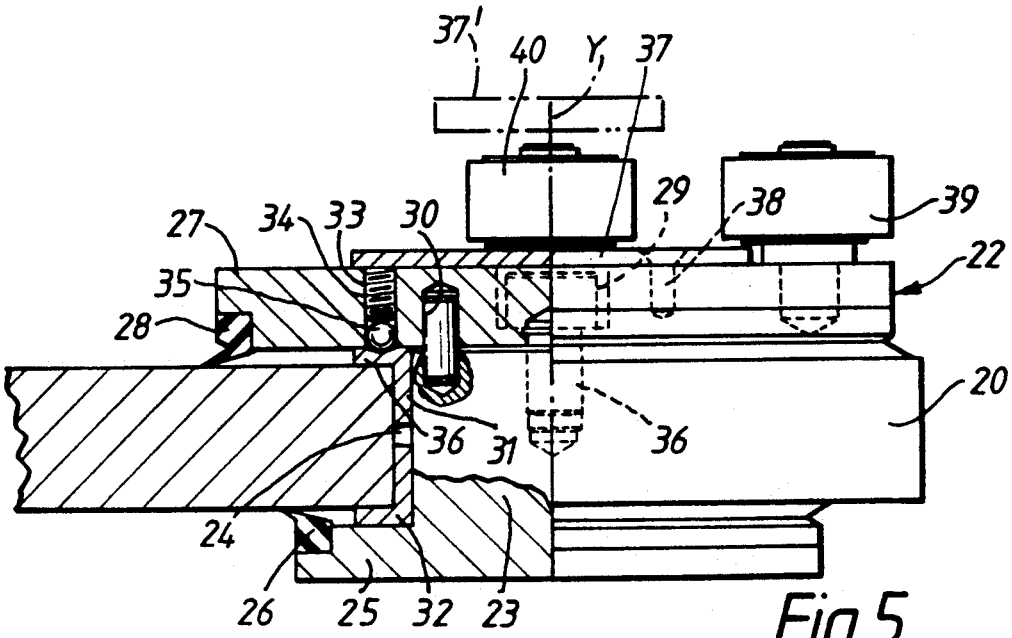
FIG. 5 shows a side elevation, partly in vertical section, of the mandrel-mounting device.

The turning of the bottom closure panels 1 takes place initially in the station II and finally in the station IV, in both of which the turning devices (not shown) act perpendicularly to the tangent to the table 20, i.e. perpendicularly to the tangent to the circular path of the mandrels 21. The turning of the top closure panels 6 takes place initially at the top closure pre-breaking station 103 and finally at the top closure sealing station 106 and the turning devices at these stations act perpendicularly to the path X, which extends radially from the axis A. Because the orientations of the bottom closure and the top closure of the liter carton C' are perpendicular to each other, as already explained with reference to FIG. 2, assuming that the liter carton sleeve C' is correctly orientated upon the mandrel at the loading station I, so that the bottom closure is correctly presented at the stations II and IV, then the top closure will be correctly presented at the top closure pre-breaking station 103 and the top closure sealing station 106. However, this would not apply to the half-gallon carton, because its top and bottom closures are orientated parallelly to each other, as already explained with reference to FIG. 1. Therefore, some means is required to turn the bottom-closed, open-topped, half-gallon carton C through 90 degrees about its own longitudinal (i.e. vertical) axis between the station IV and the top closure pre-breaking station 103. In the example shown in FIGS. 3 to 6, this is achieved by arranging for the mounting of each mandrel 21 to be rotated through 90 degrees about its own vertical axis as it leaves the station IV. Referring to FIGS. 4 and 5, each mandrel 21 (not shown in these FIGURES) is mounted upon the table by a mounting device 22 which includes a mounting bush 23 which extends through a vertical cylindrical bore 24 in the table 20 and which at its lower end includes a flange 25 carrying a lip seal 26 acting against the underneath surface of the table 20. The mandrels 21 are replaceably mounted upon the mounting devices 22 so that the size of the mandrels mounted at any one time can be selected to suit the size of the carton sleeves. To the upper end of the bush 23 is attached a circular, horizontal plate 27 also carrying at its outer periphery an annular lip seal 28 acting against the top surface of the table 20. The plate 27 is centred on the bush 23 by a central pin 36 extending into blind vertical bores in the plate 27 and the bush 23, is releasably attached to the bush and to the mandrel by two diametrically opposite headed screws 29 and is correctly located relative to the bush 23 by a locating dowel 30 extending into blind vertical bores in the bush 23 and the plate 27. Flanged, upper and lower bearing sleeves 31 and 32 rotatably support in the bore 24 the mounting formed by the bush 23 and the plate 27. In a vertical through bore 33 in the plate 27 is mounted a spring device 34 and, below that, a ball 35 which is urged by the spring device 34 to bear against the top surface of the flange 36 of the upper tearing sleeve 31. There are formed in this top surface at respective locations, spaced through 90 degrees about the vertical axis Y of the device 22, two recess-form detents. The spring device 34 bears against a circular cover plate 37 which is co-axial with the plate 27 and is attached thereto by means of screws 38. Mounted upon the top of the plate 27 so as to be rotatable about respective vertical axes spaced apart through 90 degrees around the axis Y are two needle roller followers 39 and 40.

Figure 6:
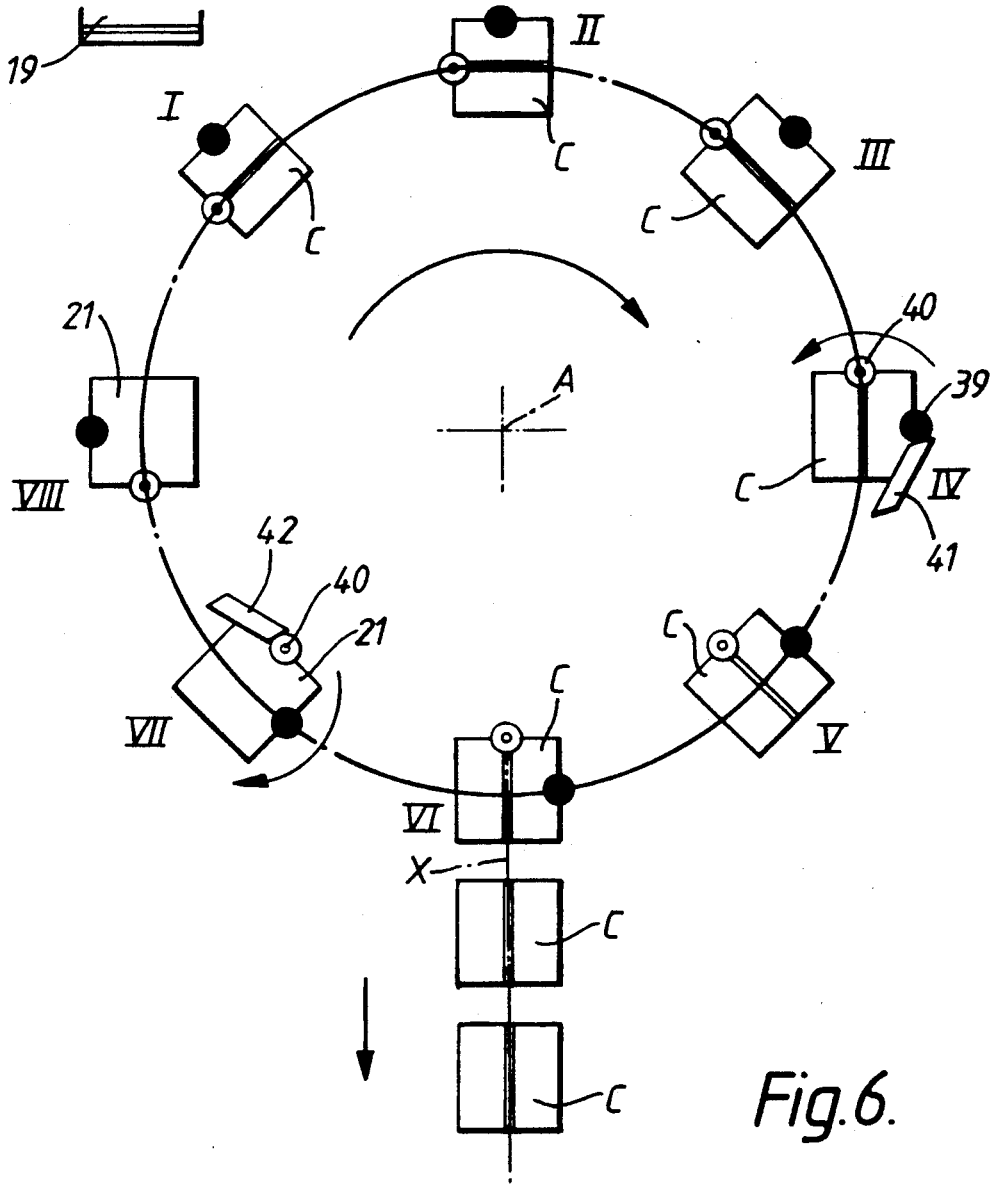
FIG. 6 shows a diagrammatic top plan view of the stepping of mandrels carried by the turntable.

In the zone of the station IV is a cam 41 which is removably fixed in the path of the follower 39, so that, as the follower 39 moves away from the station IV, the follower 39 is turned through 90 degrees about the axis Y and so turns the mounting device 22 and the mandrel 21 through the same angle, bringing the ball 35 from engagement in one detent into engagement in the other detent. This turning of the half-gallon carton C through 90 degrees is illustrated in FIGS. 3 and 6, it being understood that the cam 41 is removed from the path of the followers 39 for the liter cartons C'. After the cartons C have been removed from the turntable 20 at the station VI, the mandrel moves into the station VII and, as it moves from that station, a cam 42 permanently fixed in the path of the followers 40 swings the follower 40 and thus the mandrel 21 tack through 90 degrees about the axis Y. It will be understood that it is not necessary for the cam 42 to be retractable, because its illustrated position is out of the paths of the followers 39 and 40 for liter cartons C'.

If desired, the cover plate 37 can be provided with a bush-form extension 37' shown in dot-dash lines in FIG. 5 to bear upwardly against a support (not shown) at the station IV to absorb the force applied to the base of the mandrel during the pressure-sealing of the bottom closure at the station.

If desired, each mandrel 21 can be arranged to be water-cooled through the mounting device 22.

The apparatus described with reference to FIGS. 3 to 6 has the advantage that, because of the oscillatability of the mandrel, the machine layout for the cartons C and C' with differing closure orientation can remain the same and the machine width is kept to a reasonable size.

I claim:

1. A packaging method comprising advancing carton sleeves, sealingly closing one end of each carton sleeve at one end closing means to form a carton open at its other end, filling at filling means the cartons open at their other ends, sealingly closing at other end closing means the other end of each carton, advancing further carton sleeves, sealingly closing one end of each further carton sleeve at said one end closing means to form a further carton open at its other end, filling at said filling means the further cartons open at their other ends, and sealingly closing at said other end closing means the other end of each further carton, wherein the method further comprises, relatively to each first-mentioned carton in its path of advance from said sealingly closing its one end to said sealingly closing its other end, turning each further carton about its longitudinal axis through substantially a right angle between said sealingly closing its one end and said sealingly closing its other end, the advancing and the sealingly closing of the one ends of the carton sleeves taking place while the carton sleeves are received upon mandrels, and said turning of said further cartons being accomplished by turning of the mandrels through substantially a right angle.

2. A method according to claim 1, wherein the orientation of the closure elements of the one ends of the first-mentioned carton sleeves relative to the longitudinal axes of the first-mentioned carton sleeves is similar to the orientation of the closure elements of the other ends of the first-mentioned carton sleeves relative to the longitudinal axes of the first-mentioned carton sleeves, but the orientation of the closure elements of the one ends of the further carton sleeves relative to the longitudinal axes of the further carton sleeves is substantially perpendicular to the orientation of the closure elements of the other ends of the further carton sleeves relative to the longitudinal axes of the further carton sleeves.

3. A method according to claim 1, wherein said turning of the mandrels through substantially a right-angle to turn said further cartons is followed by removing said further cartons from said mandrels and thereafter by turning said mandrels back through substantially a right-angle prior to their receiving carton sleeves again.

4. Packaging apparatus, comprising one end closing means arranged sealingly to close one end of each of a plurality of carton sleeves to form a carton open at its other end, filling means arranged to fill the cartons open at their other ends, other end closing means arranged sealingly to close the other end of each carton, and advancing means arranged to advance said carton sleeves and said cartons along a path past said one end closing means, said filling means and said other end closing means, in turn, wherein the apparatus further comprises turning means arranged to turn each of selected ones of said cartons about its longitudinal axis through substantially a right angle as the carton passes along said path from said one end closing means to said other end closing means, selecting means serving to select which of said cartons are turned as aforesaid and thus which of said cartons remain unturned by said turning means, and a plurality of mandrel mounting means for carrying respective mandrels encircled by said carton sleeves, and supporting means carrying said mandrel mounting means, said turning means being arranged to turn said mandrel mounting means, and thus said selected ones of said cartons, through substantially a right angle relative to said supporting means.

5. Apparatus according to claim 4, and further comprising a support against which each mandrel mounting means can bear when its mandrel is subjected to a force in the direction towards the mandrel mounting means during the sealingly closing of the one end of a carton.

6. Apparatus according to claim 4, wherein each mandrel mounting means comprises a turnable mounting bush extending from one side of said supporting means towards the opposite side of said supporting means, a turnable plate at said opposite side, and fixing means fixing said plate to said bush.

7. Apparatus according to claim 4, wherein said turning means comprises follower means arranged to move with said mandrel mounting means and to turn said mandrel mounting means, and said selecting means comprises camming means arranged to co-operate with said follower means.

8. Apparatus according to claim 7, wherein said camming means is selectively locatable in and out of a path of movement of said follower means with said mandrel mounting means.

9. Apparatus according to claim 4, and further comprising other turning means arranged to turn said mandrel mounting means back through substantially a right-angle between said selected ones of said cartons being removed from said mandrels and carton sleeves being received upon said mandrels.

10. Apparatus according to claim 9, wherein said other turning means comprises follower means arranged to move with said mandrel mounting means and to turn back said mandrel mounting means through co-operation with camming means.

11. Apparatus according to claim 4, and further comprising, for each mandrel mounting means, first and second releasable retaining means between the mandrel mounting means and said supporting means and serving releasably to detain the mandrel mounting means relative to the supporting means in respective positions of turning angularly spaced apart through substantially a right-angle.

12. Apparatus according to claim 6, wherein said fixing means of each mandrel mounting means includes an elongate locating member disposed radially outwardly of the axis of said bush and acting between said plate and said bush.

13. Apparatus according to claim 6, wherein said fixing means of each mandrel mounting means includes an elongate centering member acting between and co-axial with said plate and said bush.

14. Packaging apparatus including mandrel mounting means, and one end closing means arranged to close one end of a carton sleeve encircling a mandrel carried by said mandrel mounting means, wherein the improvement comprises turning means arranged to turn said mandrel mounting means through substantially a right-angle about an axis which substantially co-incides with the longitudinal axis of the mandrel.

15. Apparatus according to claim 14, and further comprising other turning means arranged to turn said mandrel mounting means back through substantially a right-angle.

16. Apparatus according to claim 15, wherein said other turning means comprises follower means arranged to move with said mandrel mounting means and to turn back said mandrel mounting means through co-operation with camming means.

17. Apparatus according to claim 14, and further comprising camming means, said turning means comprising follower means arranged to move with said mandrel mounting means and to turn said mandrel mounting means through co-operation with said camming means.

18. Apparatus according to claim 17, wherein said camming means is selectively locatable in and out of a path of movement of said follower means with said mandrel mounting means.

* * * * *